United States Patent [19]

Massey

[11] Patent Number: 4,903,038

[45] Date of Patent: Feb. 20, 1990

[54] HORN ANTENNA ARRANGEMENT

[75] Inventor: Peter J. Massey, Crawley, England

[73] Assignee: U.S. Philips Corp., New York, N.Y.

[21] Appl. No.: 286,573

[22] Filed: Dec. 16, 1988

[30] Foreign Application Priority Data

Dec. 22, 1987 [GB] United Kingdom ..... 8729914

[51] Int. Cl.[4] ..... H01Q 13/02

[52] U.S. Cl. ..... 343/786; 333/21 R

[58] Field of Search ..... 343/786, 772; 333/21 R

[56] References Cited

U.S. PATENT DOCUMENTS

| | | | |
|---|---|---|---|
| 2,954,558 | 9/1970 | Honey et al. | 343/786 |
| 3,831,176 | 8/1974 | Epis et al. | 343/786 |
| 4,667,205 | 5/1987 | Gehin | 343/786 |

*Primary Examiner*—Rolf Hille

*Assistant Examiner*—Michael C. Wimer

*Attorney, Agent, or Firm*—Emmanuel J. Lobato

[57] ABSTRACT

A horn antenna arrangement comprising an H-plane sectoral horn 19 in combination with a feeder waveguide 2 in which radio-frequency energy is launched and propagated in the fundamental rectangular waveguide TE(1,0) mode and provided with a mode-converting section 25 of suitably shaped waveguide of reduced height in which the fundamental TE(1,0) rectangular type mode in, e.g. a planar arcuate input cross section 26, is smoothly and gradually converted into the fundamental TM(0,1) mode of an H-plane sectoral horn in an output cross section 30 which is cylindrically curved about the z axis forming the central axis of sectoral flare for the horn 19, substantially without generating any higher horn modes.

18 Claims, 4 Drawing Sheets

Fig.5.a.

HORN ANTENNA ARRANGEMENT

BACKGROUND OF THE INVENTION

The invention relates to a horn antenna arrangement comprising an H-plane sectoral horn wherein with reference to a cylindrical co-ordinate system having a rectilinear z-axis which is normal to a reference plane parallel to the H-plane, the sectoral horn has a wide angle of flare about the z-axis in the reference plane, said angle of flare being not greater than 360 degrees, the sectoral horn being bounded over the whole of said angle of flare by conductive surfaces spaced apart in the z-direction and conductively connected to conductive planar side surfaces arranged radially to the z-axis at each end of the angle of flare, and wherein the aperture of the horn substantially conforms to a notional surface which is cylindrical about the z-axis, in combination with a feeder waveguide formed between substantially orthogonally disposed first and second pairs of parallel spaced conductive surfaces, said feeder waveguide extending from the throat of the sectoral horn and being provided with launching means for launching radio-frequency energy along said feeder waveguide towards said horn substantially only in a fundamental mode over an operating frequency range. Since an antenna is reciprocal in nature it is to be understood that the feeder waveguide can additionally or alternatively receive microwave energy from the throat of the horn in substantially only said fundamental mode over the operating frequency range.

Such an antenna may be used in a broad-band direction-finding system comprising a set of N adjacent similar such antennas whose respective main beam axes are spaced at regular angular intervals of (360/N) degrees (normally in azimuth). An R.F. source whose direction relative to the system is to be found may be detected by summing the output signals of all the antennas, and said direction may be established by comparing the magnitudes of the output signals of a suitable pair of adjacent antennas of the set. In order to provide substantially the same probability of detection of an R.F. source for all angles in azimuth and in order to provide optimum accuracy in establishing the direction of the source, it is desirable that the power level of an antenna main beam (relative to its peak level) in a direction corresponding to the main beam axis of an adjacent antenna, i.e. at an angle of plus or minus (360/N) degrees to its own main beam axis, should lie approximately in the range of −8 dB to −15 dB over the operating frequency range of the system.

An antenna as set forth in the first paragraph of this specification is disclosed in British Patent GB 2 090 068 B. In that antenna, electromagnetic energy is launched into the horn towards the aperture (or mouth) of the horn by a rectangular waveguide having a pair of opposed E-plane ridges. In order to obtain a substantially constant beamwidth over an operating frequency range of 3:1 which includes a band of frequencies immediately above the cut-off frequency of the TE(3,0)mode, the ridges are spaced along the waveguide from the throat of the horn: in practice, the generation of the TE(3,O) mode by the ridged waveguide is adjusted on test to be so phased with respect to the horn as to minimise variations of beamwidth with frequency in said band immediately above the TE(3,O) cut-off frequency. Without this phasing correction the higher order modes which are generated by the abrupt transition from the rectangular waveguide feed at the throat of the horn, will also be radiated and the phase relation between these higher order modes and the fundamental mode will vary with frequency. This generally results in a radiation pattern which varies greatly with frequency. The aforementioned phasing correction attempts to overcome these variations by at least partial cancellation and results in some reduction in beamwidth variation.

It is an object of the invention to provide an improved sectoral horn antenna arrangement in which the sectoral horn can be fed from a feeder waveguide so that excitation and radiation of higher modes can be substantially reduced and variations in beam width with frequency can be reduced.

SUMMARY OF THE INVENTION

According to the invention there is provided a horn antenna arrangement of the kind specified, characterised in that electromagnetic energy is launched by said launching means so as to propagate along said feeder waveguide substantially only in the fundamental TE(1,0) waveguide mode characterised by a planar wavefront, and in that said feeder waveguide includes a mode-converting section at the input of which the waveguide has a planar elongate input cross-section transverse to the direction of flow of said radio frequency energy along the waveguide, which is bounded by said orthogonally disposed pairs of parallel spaced conductive surfaces, and the longer dimension, namely the width, taken along the longitudinal median axis of the input cross-section, is at least four times the height in a direction orthogonal to said median axis, the H-plane of said fundamental TE(1,0) waveguide mode in said cross-section being parallel to said longitudinal median axis, said mode-converting section having an output cross-section transverse to the direction of radio frequency energy flow of circumferential form which conforms substantially to a notional cylindrical surface whose cylindrical axis is the z-axis, and the longer and the shorter boundaries of the output cross-section are substantially parallel to the H-plane of the sectoral horn and to the z-axis, respectively, said output cross-section corresponding to the throat of the sectoral horn, and the waveguide forming said mode-converting section is so shaped that the path length for the flow of said radio frequency energy therethrough is substantially the same for all respective propagation paths parallel to the local energy propagation direction in the mode-converting section and each connecting a respective pair of corresponding points in said cross-sections at the respective ends of the mode-converting section, the arrangement being such that substantially only the lowest order horn mode TM(0,1) is excited in the sectoral horn by said radio frequency energy.

The width of the planar input cross-section of the mode-converting section can be greater than six times the height and is preferably from nine to eleven times the height thereof and said planar input cross-section can be arcuate in form with the longitudinal median axis thereof monotonically curvilinear, preferably a circular arc.

Although it is possible to make the mode-converting section rectilinear it is preferable that the plane containing the planar input cross-section thereof should be inclined to the z-axis and a convenient arrangement is that the z-axis should be normal to the plane containing said planar input cross section. This means that the mode-converting section must in the longitudinal direction be gradually curved through the corresponding angle.

The remainder of the feeder waveguide can comprise a waveguide whose planar cross section is uniform and corresponds to that of the planar input cross section of the mode-converting section. Alternatively, the remainder of the feeder waveguide can comprise a conventional rectangular waveguide followed by a rectilinear height reducing section which can either feed the mode-converting section directly or, in the case of the arcuate planar input cross-section, via a curvature transition section which is so shaped that a waveguide phase pattern in the planar input cross-section of the transition is correspondingly mapped in the planar arcuate output cross-section which corresponds to the input of the mode-converting section. The height-reducing section and the curvature transition section must also involve smooth gradual transitions in order to reduce as far as possible generation of higher order modes.

Theoretical modelling shows that if only one of the horn modes TM(m,1), is excited then the H-plane radiation pattern remains almost constant over a wide bandwidth. In practice only the lowest order (fundamental) horn mode TM(0,1) should be excited in the horn flare because the use of a higher order TM(m,1) mode can lead to undesirable features in the E-plane beam pattern. The feeder should therefore supply the horn flare with only the latter's fundamental mode. The horn modes are referred to herein using the convention employed in "Time Harmonic Electromagnetic Fields" by R.F. Harrington, published by McGraw Hill (1961).

The invention is based on the realisation that the fundamental mode of the horn flare at, for example, the throat of an H-plane sectoral horn when taken on a cross-section of constant radius about the z-axis, is similar to the fundamental TE(1,0) mode of a rectangular waveguide when taken on a planar cross-section transverse to the waveguide, and that by introducing between, say a rectangular waveguide and the throat of a sectoral horn, a suitable waveguide transition in which all the phase-points on a planar input cross-section are directly mapped onto corresponding phase-points on an output cross-section conforming to a horn throat which is cylindrical about the z-axis via propagation paths of equal length, a substantially matched conversion of a fundamental waveguide mode excited in the feeder guide, into the fundamental horn mode, can be achieved.

BRIEF DESCRIPTION OF THE DRAWING

The present invention will now be explained and described, by way of example, with reference to the accompanying drawings, of which:

FIG. 5*a* is a perspective diagram partly in section illustrating an alternative horn antenna arrangement in accordance with the invention.

DETAILED DESCRIPTION OF THE INVENTION

Figure 1A:
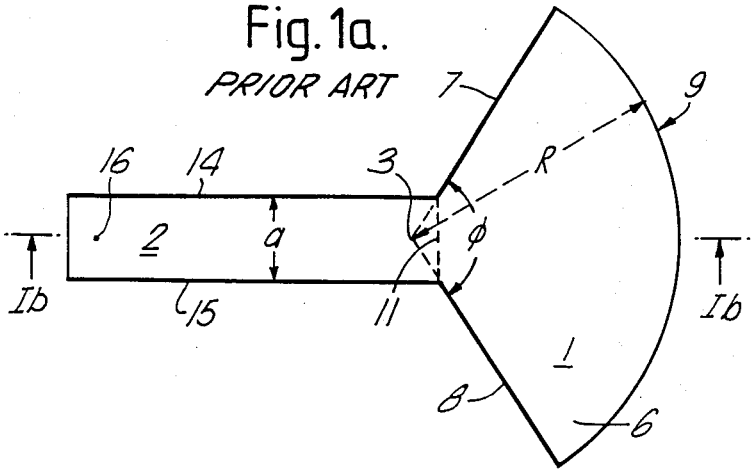
Fig. 1a. PRIOR ART
FIGS. 1*a* and 1*b* are diagrams illustrating in a general manner a prior horn antenna arrangement.
Figure 1B:
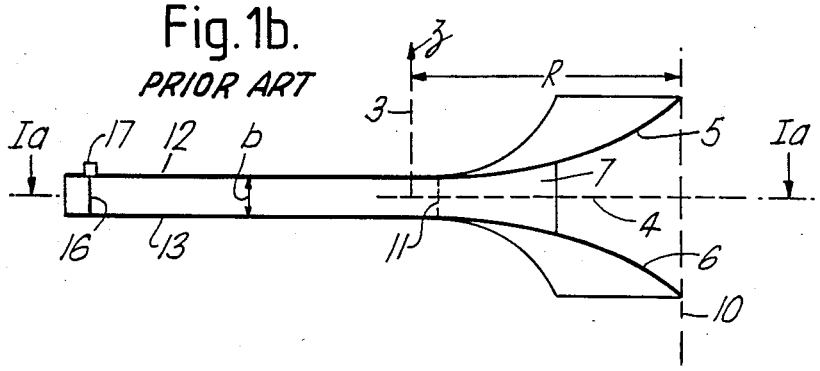
Fig. 1b. PRIOR ART

FIG. 1*a* and 1*b* are diagrams illustrating in general form, in plan and in vertical section, respectively, a horn antenna arrangement of the kind specified in the introductory paragraph. The horn antenna arrangement comprises an H-plane sectoral horn 1 in combination with a feeder waveguide 2. The sectoral horn 1 can conveniently be described with reference to a cylindrical co-ordinate system having a rectilinear z-axis 3 which is normal to a reference plane 4 which is parallel to the H-plane of the sectoral horn. The sectoral horn 1 has a wide angle of flare, phi, about the z-axis 3 in the reference plane 4, and is bounded over the whole angle of flare by electrically conductive surfaces 5,6, spaced apart in the z-direction about the reference plane 4. The horn 1 is further bounded by electrically conductive planar side surfaces 7,8, arranged radially to the z-axis at each end of the angle of flare, phi, which are conductively connected to the upper and lower surfaces 5,6. The radiating aperture of the sectoral horn 1 substantially conforms to a notional surface on imaginary reference surface 10 which is cylindrical and of radius R about the z-axis. In FIGS. 1*a* and 1*b*, the throat of the horn 1 is represented by the junction 11 between the horn 1 and the feeder waveguide 2.

The feeder waveguide 2 is formed between substantially orthogonally disposed first and second pairs of parallel spaced conductive surfaces 12,13 and 14,15, respectively. The feeder waveguide 2 shown in FIGS. 1*a* and 1*b* is a rectangular waveguide whose cross section has a width a greater than the height b. The feeder waveguide 2 extends back from the throat 11 of the sectoral horn 1 and is provided with launching means 16 in the form of a probe connected to the center conductor of a coaxial feed cable 17. The launching probe 16 can be associated with a waveguide ridge in conventional manner in order to extend the bandwidth of the coupling. The probe 16 is arranged to launch the fundamental mode TE(1,0) of the rectangular waveguide 2 and the guide is dimensioned so that the fundamental mode is the only one supported over the operational frequency range.

The horn antenna arrangement thus described with reference to FIGS. 1*a* and 1*b* is illustrative of prior antenna arrangements and suffers the disadvantage that the abrupt transition from a rectangular guide 2 to the flare of the sectoral horn 1 at the throat 11 causes higher horn modes than the fundamental horn mode TM(0,1) to be generated by the transition and propagated and radiated by the horn. By a process of interference between the higher and the fundamental modes, the radiation pattern in the H-plane is caused to vary considerably with frequency, whereas in the absence of higher horn modes the radiation pattern due to the fundamental mode provides a beam width which is substantially constant with frequency over a considerable frequency span of about 3 to 1. The aforementioned British Patent GB 2,090,068 B discloses a horn antenna arrangement in which a symmetrical pair of E-plane ridges are set in a rectangular waveguide feeder which is slightly tapered out towards the horn and is provided with a section of plain rectangular waveguide between the end of the ridges and the throat of the horn. The E-plane ridges cause higher order modes to be generated in the waveguide, and in practice it has been found possible to adjust the phase of these higher order modes relative to those generated by the waveguide-to-horn transition so that the higher modes generated by the different processes interact at the horn mouth and at least partially cancel one another to give a more uniform beamwidth with frequency. This arrangement, relying as it does on balancing one source of higher modes against another, is unsatisfactory, however, and tends to give uncertain results.

As a basis for a horn antenna arrangement in accordance with the invention it was realised that because the fundamental mode TM(0,1) in the flare of the sectoral horn 1, conforms in the reference plane 4 to a circumferential pattern which can be thought of as propagating outwardly as a sequence of phase surfaces whose projections in the plane 4 are circular arcs centred on the z-axis 3 of progressively increasing radius, the throat of the horn should also conform substantially in cross-section to a further notional cylindrical surface whose cylindrical axis is the z-axis. It was then realised that the fundamental TM(0,1) horn mode field distribution around a cylindrical throat cross-section matches the field distribution in a planar cross-section of a rectangular waveguide when excited in only the fundamental TE(1,0) mode.

Figure 2A:
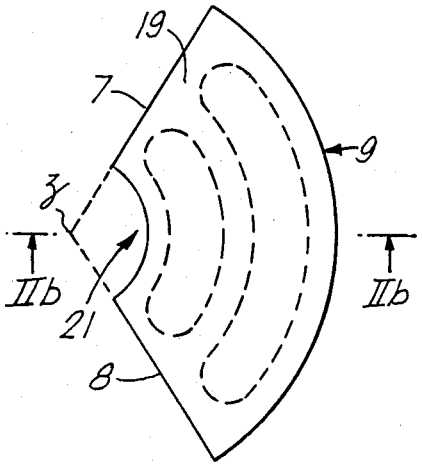
FIGS. 2*a* and 2*b* are plan and side elevation sectional diagrams of a sectoral horn.
Figure 2B:
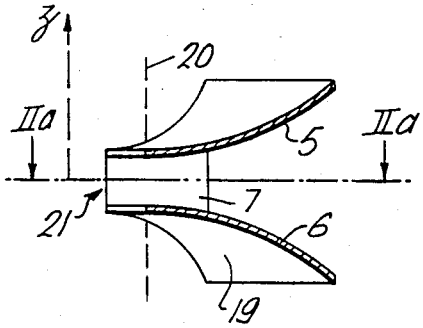

Therefore in accordance with the invention the feeder waveguide is provided with a mode-converting waveguide section which is shaped along the propagation direction so that the fundamental TE(1,0) waveguide mode applied at a planar input cross-section is converted to a fundamental horn mode TM(0,1) at a cylindrical output cross section which matches the cylindrical throat cross section of the sectoral horn. This is illustrated in FIGS. 2*a* and 2*b* which are diagrams representing a sectoral horn 19 in horizontal and vertical section, respectively. In FIG. 2*a* taken in the reference plane 4 referred to in FIG. 1*b*, the H-field of the fundamental mode TM(0,1) is illustrated by dashed lines. The notional cylindrical surface 20 centred on the z-axis to which the cross-section of the throat 21 of the horn conforms, is indicated in FIG. 2*b*.

Figure 3:
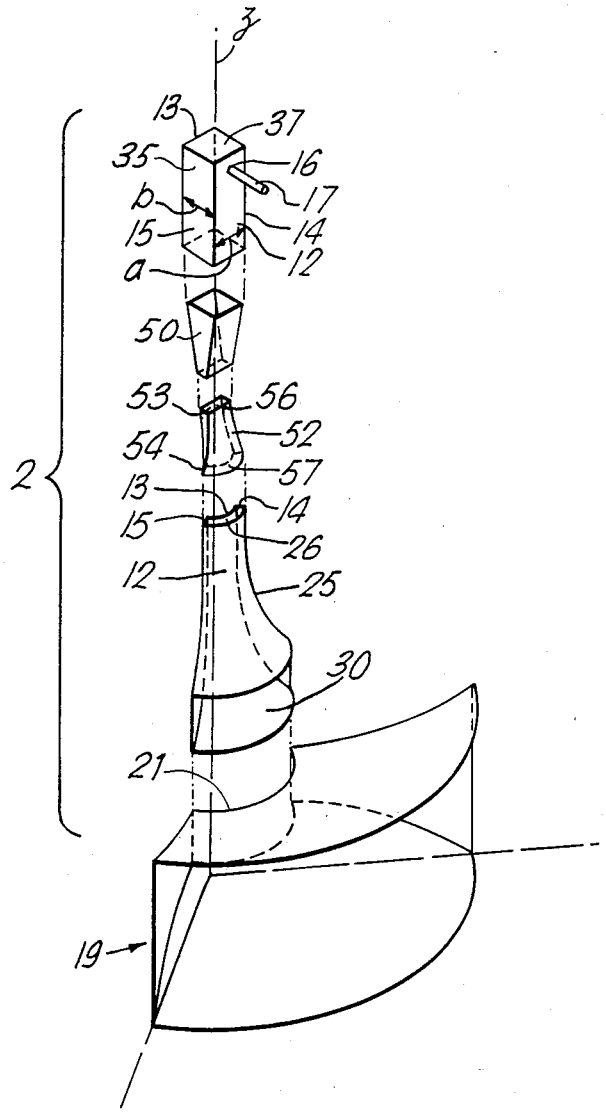
FIG. 3 is an exploded diagram illustrating a horn antenna arrangement in accordance with the invention.

Thus in a horn antenna arrangement in accordance with the invention and illustrated in an exploded diagram in FIG. 3, the feeder waveguide 2 includes a mode-converting section 25 at the input 26 of which the feeder waveguide 2 has a planar elongate cross-section transverse to the direction of flow of radio-frequency energy along the waveguide which is bounded by the orthogonally disposed pairs of parallel spaced conductive surfaces 12,13, and 14,15, forming the walls of the feeder waveguide 2. The longer dimension of the elongate input cross-section 26, referred to herein as the width, taken along the longitudinal median axis 28 (FIG. 4) of the cross-section 26 is at least four times the height of the cross section 26 in a direction orthogonal to the axis 28. In practice it is desirable for the width to be greater than six times the height, and preferably to lie in the range nine to eleven times the height. In the present example the width is ten times the height and this forms a satisfactory compromise between the requirement that the fundamental rectangular waveguide mode should be maintained with the least risk of higher modes being generated which necessitates that the height be small compared with the width, and the fact that too great a reduction in the height relative to the width will eventually lead to unacceptable energy loss.

Figure 4:
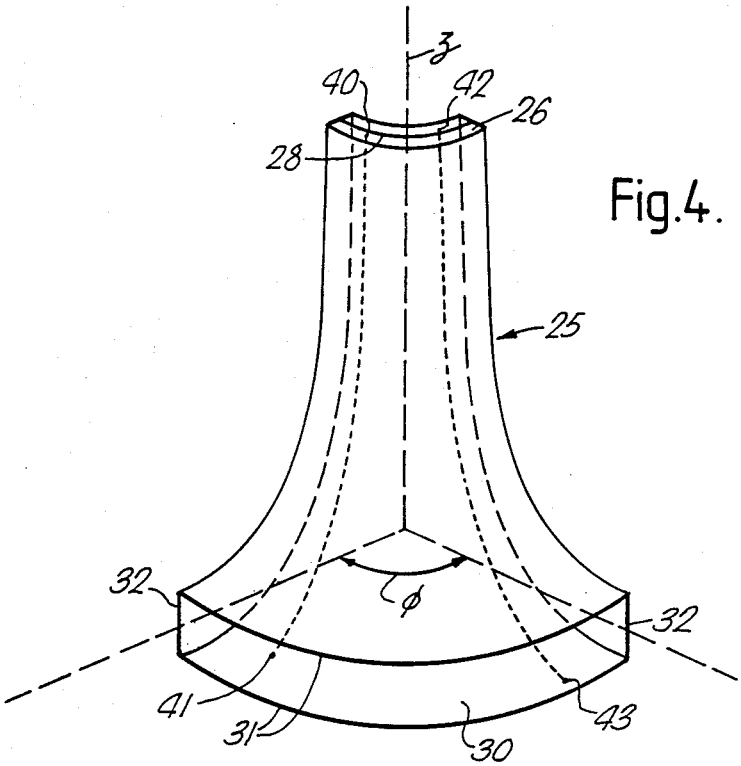
FIG. 4 is an enlarged diagram illustrating the mode-converting section forming part of FIG. 3.

As illustrated in FIG. 3 and the enlarged diagram of the mode-converting section 25 illustrated in FIG. 4, the waveguide planar cross-section 26 at the input of the section 25, is arcuate and the longitudinal median axis 28 thereof is monotonically curvilinear and, in the present example, forms a circular arc. The H-plane of the fundamental TE(1,0) mode of the feeder waveguide 2, is parallel to the longitudinal median axis 28 of the planar transverse input cross-section 26.

The mode-converting section 25 has an output cross-section 30 transverse to the direction of radio-frequency energy flow therethrough of circumferential form which conforms substantially to a notional cylindrical surface whose cylindrical axis is the z-axis. The cross-section 30 is elongate and the longer and shorter boundaries 31 and 32 are substantially parallel to the H-plane of the sectoral horn and to the z-axis, respectively. The output cross-section 30 corresponds to the cylindrical throat 21 of the sectoral horn 19.

The waveguide forming the mode-converting section 25 is shaped between the input cross-section 26 and the output cross-section 30 so that the path length for the flow of radio-frequency energy through the section 25 is substantially the same for all respective propagation paths parallel to the local energy propagation direction, each path connecting a respective pair 40,41 or 42,43 of corresponding points in the input and output cross-sections 26,30, respectively.

The shape of the mode-converting section 25 can readily be derived by means of a computer program. The constraints are set by the form of the planar input and cylindrical output cross-section and the aforesaid constant distance between the corresponding input and output points. A further constraint is that changes of direction of radio-frequency energy through the section should be smooth and gradual in order to reduce as far as possible the generation of higher modes.

Thus the mode-converting section 25 takes the waveguide mode at the input 26 which corresponds to the fundamental TE(1,0) mode of a rectangular waveguide, albeit with an increased ratio of width to height, across a planar section, and converts it at the output into the fundamental TM(0,1) mode in a cylindrical transverse section which is characteristic of the required fundamental mode of the sectoral horn. Because no significant amount of energy is converted into higher modes, the output beam of the horn can have the required uniformity of beamwidth over the desired wide operational frequency band.

In the shape of the section 25 shown in FIGS. 3 and 4, the planar input cross-section 26 is contained in a plane which is inclined to the z-axis of the sectoral horn and in the example the z-axis is normal to the plane of the cross-section 26.

In the embodiment illustrated in FIG. 3, the remainder of the feeder 2 comprises a conventional rectangular waveguide 35 whose cross-section has a width a which is greater than the height b, and provided at the closed end 37 with a conventional launching probe 16 connected to the center conductor of a coaxial feed cable 17 and conventionally associated with a short waveguide ridge, if desired, in order to extend the bandwidth of the coupling. The probe 16 is arranged to launch the fundamental TE(1,0) mode in the rectangular waveguide 35 in which the H-plane is parallel to the width direction, and the guide is dimensioned so that the fundamental mode is the only one supported over the operational frequency range.

The ratio of width to height of a conventional rectangular waveguide is relatively small i.e. about 2:1. Consequently, in order to increase this ratio to 10:1 in the present example, a rectilinear transition section 50 is provided, fed by the rectangular waveguide section 35, which gradually reduces the height dimension of the cross-section of the feeder waveguide 2 until the ratio of the width a to the height b is substantially the same as the corresponding ratio associated with the planar input cross-section 26 of the mode-converting section 25.

In order to match the reduced height rectangular output cross-section of the rectilinear transition section 50 to the arcuate planar input cross-section 26 of the mode-converting section 25, the section 50 is followed by a curvature transition section 52 whose planar input cross-section 53 corresponds to the output cross-section of the rectilinear transition section 50, and having an output planar cross-section 54 which corresponds to the arcuate planar input cross-section 26 of the mode-converting section 25. The curvature transition section is shaped in a gradual manner along its length so that the path length for the flow of radio-frequency energy therethrough is substantially the same for all respective propagation paths, for example 55, parallel to the energy propagation direction within the curvature transition section 52 and each connecting a respective pair 56,57, of corresponding points in the respective planar input and output cross-sections 53,54, of the curvature transition section 52. The progressive transverse curvature applied to the reduced height rectangular waveguide section at the input 53 in passing along the section 52, is made smooth and gradual so that no significant amount of energy is transferred to higher waveguide modes. The shape of the curvature transition section 53 can be readily effected by computer as in the case of the mode-conversion section.

In order to preserve the fundamental rectangular waveguide mode pattern in the curvature transition section 52, both the height and the width of the guide cross-section is maintained substantially constant although it will be understood that the width is measured along the longitudinal median axis, e.g. 28, of the cross-section as it is made progressively more curved along the length of the transition section 52.

On the other hand, in the case of the mode-conversion section 25, in which the planar input cross-section is converted into a cylindrical output cross section, the width of the cross-section of the mode-conversion section 25 measured along the median axis, e.g. 28, of the cross-section, will be subjected to a progressive and gradually increasing rate of increase (flare) until the latter equals the flare angle of the sectoral horn at the output cross-section 30. The height of the cross-section of the mode-converting section 25 can also have a smaller, gradually increasing amount of flare which, at the throat 21 of the sectoral horn 19, has the same flare angle as the horn flare angle in a plane containing the z-axis.

Figure 5B:
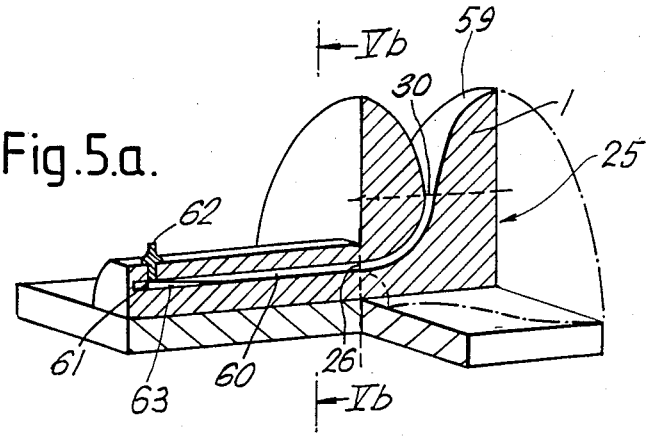
FIG. 5*b* is a cross-section of part of FIG. 5*a*.

FIG. 5*a* illustrates in perspective and partial section, an alternative embodiment of a horn antenna arrangement in accordance with the invention, in which a sectoral horn antenna 59 having a flare angle of 180 degrees, is fed via a mode-converting section 25 of the feeder waveguide 2. In this embodiment, the remainder of the feeder waveguide comprises a waveguide 60 whose planar cross-section which is illustrated in the sectional diagram FIG. 5*b*, is uniform and corresponds to the planar input cross-section of the mode-converting section 25 which in the example illustrated extends over a semicircular arc.

It has been found that this cylindrically distorted form of a flat rectangular waveguide, can be excited in the fundamental mode corresponding to the TE(1,0) mode of a rectangular waveguide, by means of a conventional probe. Thus the waveguide 60 is excited by a probe 61 placed symmetrically about the centre line of the waveguide 60 and connected to the central conductor of a coaxial feeder 62. A tapered ridge 63 is provided adjacent the probe, in conventional manner in order to provide a wide bandwidth feed.

Theoretical calculations made by the inventor and confirmed by measurement have shown that the 3dB beamwidth of a sectoral horn in the H-plane, is one half the corresponding angle of flare. The sectoral horn antenna shown in FIG. 5 has a flare angle of 180 degrees which therefore implies a 3dB beamwidth of 90 degrees. Two of the antennas of FIG. 5 can be mounted back to back vertically on a mast and a further back-to-back pair of similar antennas can be mounted above or below the first pair and oriented at 90 degrees thereto to enable a 360 degree azimuth coverage to be obtained in a direction-finding arrangement.

Figure 5B:
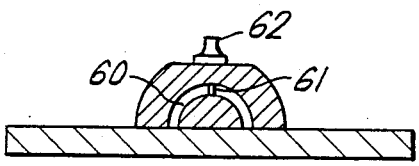
Figure 6:
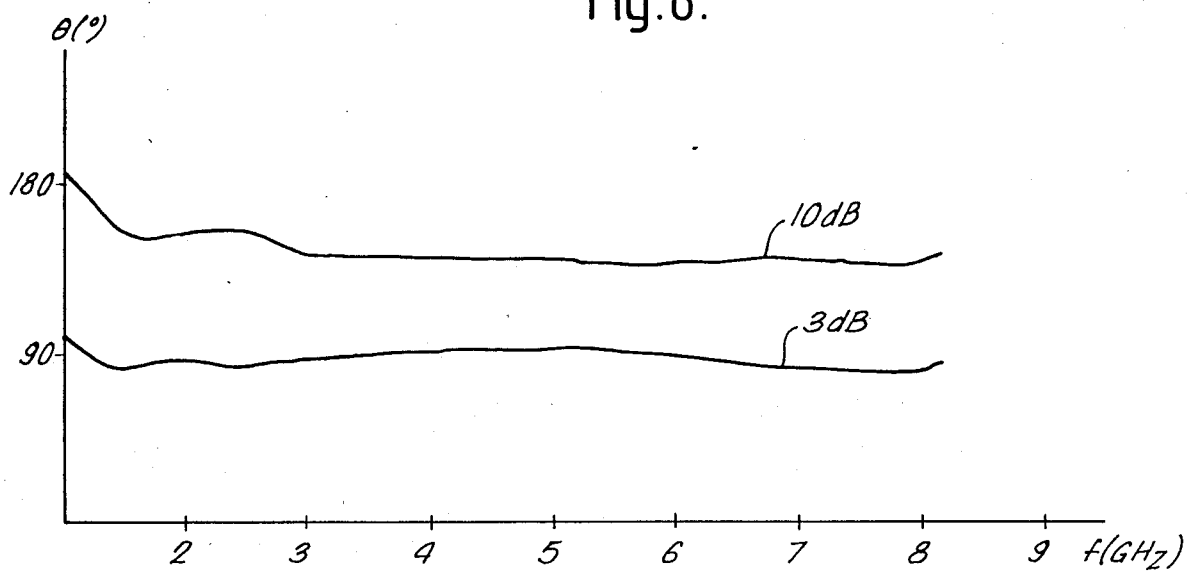
FIG. 6 is a graph illustrating the performance of the arrangement of FIG. 5.

The performance of one example of the horn antenna of FIG. 5 is illustrated in FIG. 6 by a graph of the beam width theta at 3dB and 10dB down over the central response against frequency. It will be apparent that the beamwidth remains substantially steady over a frequency range of three to one. This is about the limit of the performance using a rectangular waveguide feed, because providing that the aperture radius of the sectoral horn is sufficiently large, the wide-band performance of this horn is substantially only limited by the ability of the rectangular waveguide feed to supply only one mode. Since the coaxial feed is placed symmetrically about the centre line of the waveguide it can only generate symmetrical modes in the waveguide and this means that the feeder will carry only the fundamental mode over a three to one bandwidth. However at frequencies above this band, higher order symmetric modes can propagate in the waveguide.

I claim:

1. A horn antenna arrangement comprising an H-plane sectoral horn wherein, with reference to a cylindrical co-ordinate system having a rectilinear z-axis which is normal to a reference plane parallel to the H-plane, the sectoral horn has a wide angle of flare about the z-axis in the reference plane, said angle of flare being not greater than 360 degrees, the sectoral horn being bounded over the whole of said angle of flare by conductive surfaces spaced apart in the z-axis direction and conductively connected to conductive planar side surfaces arranged radially to the z-axis at each end of the angle of flare, and wherein the aperture of the horn substantially conforms to an imaginary reference surface which is cylindrical about the z-axis, in combination with a feeder waveguide formed between substantially orthogonally disposed first and second pairs of parallel spaced conductive surfaces, said feeder waveguide extending from the throat of the sectional horn and being provided with launching means for launching radio-frequency energy along said feeder waveguide towards said horn substantially only in a fundamental mode over an operating frequency range, characterized in that electromagnetic energy is launched by said launching means so as to propagate along said feeder waveguide substantially only in the fundamental TE(1,0) waveguide mode characterised by a planar wavefront, and in that said feeder waveguide includes a mode-converting section having an input at which the waveguide has an input of planar elongate cross-section transverse to the direction of flow of said radio frequency energy along the waveguide, which is comprised of said orthogonally disposed pairs of parallel spaced conductive surfaces, and the longer width dimension, taken along a longitudinal median axis of the input cross-section, is at least four times the height in a direction orthogonal to said median axis, the H-plane of said fundamental TE(1,0) waveguide mode in said cross-section being parallel to said longitudinal median axis, said mode-converting section having an output cross-section of circumferential form transverse to the direction of radio frequency energy flow which conforms substantially to an imaginary cylindrical reference surface whose axis is the z-axis, and said output cross-section having longer and shorter boundaries substantially parallel to the H-plane of the sectoral horn and to the z-axis, respectively, said output cross-section corresponding to the throat of the sectoral horn, and the waveguide forming said mode-converting section is so shaped that the path length for the flow of said radio frequency energy therethrough is substantially the same for all respective propagation paths parallel to the local energy propagation direction in the mode converting section and each connecting a respective pair of corresponding points in said cross-sections at the respective ends of the mode-converting section, the arrangement being such that substantially only the lowest order horn mode TM(0,1) is excited in the sectoral horn by said radio frequency energy.

2. A horn antenna arrangement as claimed in claim 1, wherein said width of said planar cross-section input is greater than six times said height.

3. A horn antenna arrangement as claimed claim 1 or 2, characterised in that said planar cross-section input is arcuate and the longitudinal median axis thereof is monotonically curvilinear.

4. A horn antenna arrangement as claimed in claim 1 or 2, characterised in that the plane containing said planar cross-section input is inclined to the z-axis.

5. A horn antenna arrangement as claimed in claim 4, characterised in that the z-axis is normal to the plane containing said planar cross-section input.

6. A horn antenna arrangement as claimed in any one of claims 1 or 2, characterised in that the remainder of said feeder waveguide comprises a waveguide whose planar cross-section is uniform and corresponds to the planar cross-section of the input of the mode-converting section.

7. A horn antenna arrangement as claimed in claim 6, characterised in that said launching means is a coaxial to waveguide mode-transducer in the form of a probe.

8. A horn antenna arrangement as claimed in claim 7, characterised in that an E-plane ridge is disposed adjacent said probe and has a height which decreases with distance from the probe so as to increase the bandwidth of the launching probe.

9. A horn antenna arrangement as claimed in any one of claims 1 or 2, characterised in that the remainder of said feeder waveguide comprises a rectangular waveguide having a transverse section whose width is a and whose height is b, where a is greater than b, and which is provided with launching means for launching a fundamental TE(1,0) mode in which the H-plane is parallel to the width direction, followed by a rectilinear transition section of guide which gradually reduces the height dimension of the feeder waveguide cross-section so that the ratio of the width a to the height b is substantially the same as the ratio of the width to the height of said planar cross-section input of said mode-converting section.

10. A horn antenna arrangement as claimed in claim 9, characterised in that said rectilinear transition section is followed by a curvature transition section whose planar cross-section input corresponds to the cross-section at the output of said rectilinear transition section, and whose output planar cross-section corresponds to the arcuate planar cross-section input of the mode-converting section, said curvature transition section being so shaped in a gradual manner that the path length for the flow of said radio frequency energy therethrough is substantially the same for all respective propagation paths parallel to the energy propagation direction in the curvature transition section and each connecting a respective pair of corresponding points in the respective planar cross-sections of the input and output of the curvature transition section substantially without generating any higher waveguide modes.

11. A horn antenna arrangement as claimed in claim 3, characterized in that the plane containing said planar cross-section input is inclined to the Z-axis.

12. A horn antenna arrangement as claimed in claim 11, characterized in that the z-axis is normal to the plane containing said planar cross-section input.

13. A horn antenna arrangement as claimed in claim 3, characterized in that the remainder of said feeder waveguide comprises a waveguide whose planar cross-section is uniform and corresponds to the planar cross-section input of the mode-converting section.

14. A horn antenna arrangement as claimed in claim 4, characterized in that the remainder of said feeder waveguide comprises a waveguide whose planar cross-section is uniform and corresponds to the planar cross-section input of the mode-converting section.

15. A horn antenna arrangement as claimed in claim 5, characterized in that the remainder of said feeder waveguide comprises a waveguide whose planar cross-section is uniform and corresponds to the planar cross-section input of the mode converting section.

16. A horn antenna as claimed in claim 3, characterized in that the remainder of said feeder waveguide comprises a rectangular waveguide having a transverse section whose width is a and height is b, where a is greater than b, and which is provided with launching means for launching a fundamental TE(1,0) mode in which the H-plane is parallel to the width direction, followed by a rectilinear transition section of guide which gradually reduces the height dimension of the feeder waveguide cross-section so that the ratio of the width a to the height b is substantially the same as the ratio of the width to the height of said planar cross-section input of said mode-converting section.

17. A horn antenna as claimed in claim 4, characterized in that the remainder of said feeder waveguide comprises a rectangular waveguide having a transverse section whose width is a and whose height is b, where a is greater than b, and which is provided with launching means for launching a fundamental TE(1,0) mode in which the H-plane is parallel to the width direction, followed by a rectilinear transition section of guide which gradually reduces the height dimension of the feeder waveguide cross-section so that the ratio of the width a to the height b is substantially the same as the ratio of the width to the height of said planar cross-section input of said mode-converting section.

18. A horn antenna as claimed in claim 5 characterized in that the remainder of said feeder waveguide comprises a rectangular waveguide having a transverse section whose width is a and whose height is b, where a is greater than b, and which is provided with launching means for launching a fundamental TE(1,0) mode in which the H-plane is parallel to the width direction, followed by a rectilinear transition section of guide which gradually reduces the height dimension of the feeder waveguide cross-section so that the ratio of the width a to the height b is substantially the same as the ratio of the width to the height of said planar cross-section input of said mode-converting section.

* * * * *